US007044816B2

(12) United States Patent
Henry

(10) Patent No.: US 7,044,816 B2
(45) Date of Patent: May 16, 2006

(54) JET DRIVE AND RETRACTABLE RUDDER FIN AND FILTER SYSTEMS AND METHODS FOR WATERCRAFT

(76) Inventor: Howarth Peter Henry, 666 W. 19th St., #1807, Costa Mesa, CA (US) 92627

( * ) Notice: Subject to any disclaimer, the term of this patent is extended or adjusted under 35 U.S.C. 154(b) by 0 days.

(21) Appl. No.: 10/772,901

(22) Filed: Feb. 5, 2004

(65) Prior Publication Data

US 2004/0157508 A1 Aug. 12, 2004

Related U.S. Application Data

(60) Provisional application No. 60/445,666, filed on Feb. 7, 2003.

(51) Int. Cl.
*B63H 11/00* (2006.01)

(52) U.S. Cl. ..... 440/38

(58) Field of Classification Search ..... 440/38, 440/43, 41, 42, 83, 75
See application file for complete search history.

(56) References Cited

U.S. PATENT DOCUMENTS 3,003,300 A * 10/1961 Jepson ..... 56/10.8
5,100,350 A * 3/1992 Buzzi ..... 440/82
5,356,319 A * 10/1994 Parker ..... 440/38
5,873,336 A * 2/1999 Uchida ..... 123/90.31
6,302,047 B1 * 10/2001 Cannon ..... 114/164
2003/0082964 A1 * 5/2003 Simner ..... 440/43

* cited by examiner

*Primary Examiner*—Stephen Avila
(74) *Attorney, Agent, or Firm*—Foley & Lardner LLP

(57) ABSTRACT

A watercraft is fitted with any one or combination of a retractable rudder fin and filter systems and improved jet drive systems. A retractable rudder-fin and filter system includes an extendable/retractable blade and a mechanism for extending the blade a variable amount from below a watercraft upon sufficient reduction or cutting-off of power from the drive system. An improved jet drive system is powered by an engine that is supported within a take-out jet structure. The take-out jet structure has an inner housing in which the engine block and jet pump are supported for operation, an outer housing fixed or unitary with the watercraft hull and a suspension structure for suspending the inner housing within the outer housing. The suspension structure has tubing that is pressurized with a gas or fluid. The engine may have a camshaft sprocket or pulley that is configured to be directly connected to drive the impeller or rotor at half-speed drive relative to the engine crankshaft.

10 Claims, 7 Drawing Sheets

FIG. 12
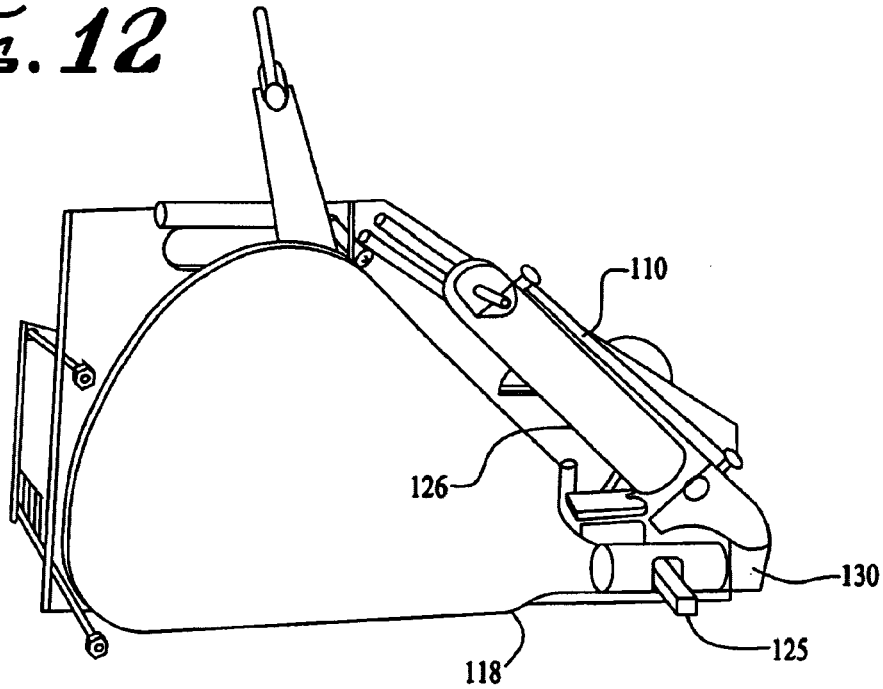
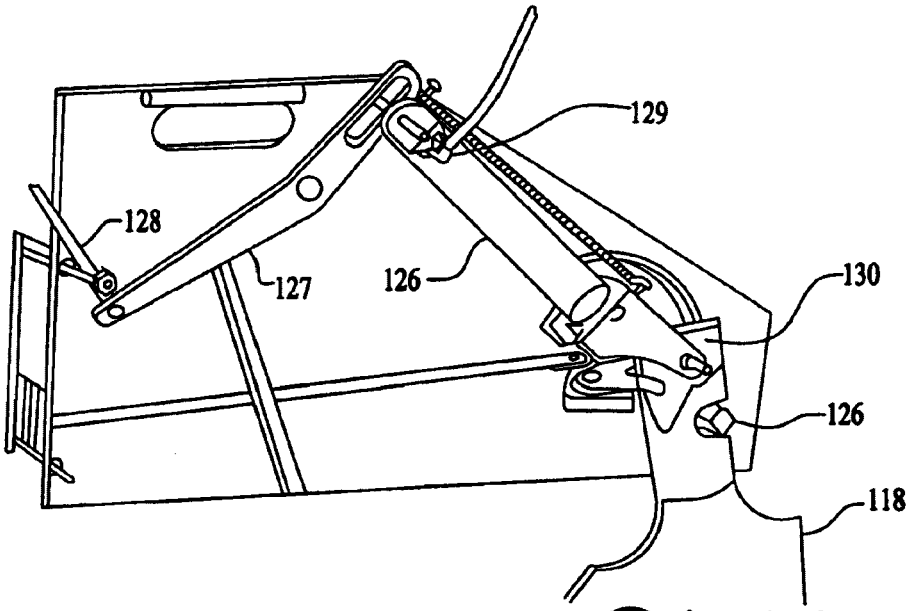
FIG. 13

126
130
132
137
134
140
125
136
138
118

JET DRIVE AND RETRACTABLE RUDDER FIN AND FILTER SYSTEMS AND METHODS FOR WATERCRAFT

CROSS-REFERENCE TO RELATED PATENT APPLICATION

This invention relates to and claims the benefit under 35 USC 119(e) of U.S. Provisional Application No. 60/445,666, filed Feb. 7, 2003, which is incorporated herein by reference in its entirety.

FIELD OF THE INVENTION

The present invention relates to improved jet drive systems and to retractable rudder-fin and filter systems for watercraft, which may be used individually or in combination on various types of watercraft.

BACKGROUND OF THE INVENTION

From the earliest forms of transportation on water, various types of propulsion systems have been employed on watercraft. Boats have been propelled by oars, paddle wheels, propellers and, in modem times, jet drive systems.

The propeller replaced both the side and stem paddle wheels about 150 years ago. It is still a primary method of providing thrust, even on huge modem aircraft carriers and cruise ships. But the fast-moving, sharp blades, usually made of polished stainless steel, can be most unsuitable for the propulsion of small recreational boats at beaches, lakes or rivers where swimmers, children and novice watercraft operators intermix. The safety hazards of propeller-driven watercraft in such contexts has contributed to the popularity of modem jet drive systems for small watercraft, including Personal Water Craft (PWC), such as jet skis, WaveRunners™ (a trademark of Yamaha Corporation) or the like.

Watercraft that are powered by jet drive systems are typically steered by a moveable sleeve placed around the jet stream, pivotal on a vertical axis, with a linkage connection to the handlebars or a steering wheel. Turning this sleeve deflects the jet stream and steers the boat. However, if the power is turned off, there is no jet stream to effect steering, even though the watercraft may still be moving at a considerable speed while slowing down. In such instances, momentum can cause the watercraft to simply continue straight on its path at the time the jet stream was cut off, while decelerating. The lack of steering control in such instances, can result in safety hazards and can take new operators by surprise.

Watercraft drive systems often include one or more propellers or jet pumps with impellers that are driven by an engine. Propellers and jet impellers can become less efficient at high speeds, such as the speeds at which many modern engines run at peak power output. Common outboard and stern drive systems typically include relatively expensive bevel gears between the engine and the propeller, which are used to reduce the engine speed at the propeller. However, jet drive systems typically include a jet pump that is directly coupled to the engine, where it may not be economical to interpose reduction gears between the pump and the engine.

Another problem for watercraft manufacturers is that the molds for the hull of small boats are relatively expensive. To help minimize costs, manufacturers often employ a basic hull that is common to several layouts of deck, interior plans and power choices, both size and type of outboard, stem drive or jet.

The shape of the hull (the "V" shape) contributes to the directional stability of the boat. Typically, the sharper the hull shape, the more stability, but at the expense of lower top speed and higher fuel consumption. To improve speed, fuel efficiency or both, the "V" shape of some hulls have been made as flat as possible and skegs or fins have been employed to improve stability. However, there should be nothing protruding below the water line in a jet-powered boat, so the same hull design which is stable at top speed with an outboard or stem drive, may not be as directionally stable when fitted with a jet drive system.

SUMMARY OF THE DISCLOSURE

Embodiments of the present invention relate to retractable rudder-fin and filter systems and to improved jet drive systems for watercraft, which may be used individually or in combination on various types of watercraft. Further embodiments relate to watercraft employing any one or combination of such systems.

Embodiments of the retractable rudder-fin and filter systems include at least one extendable and retractable blade. The system includes a mechanism for extending the blade a variable amount from below a watercraft upon sufficient reduction or cutting-off of power from the drive system. In preferred embodiments, the watercraft is powered by a jet drive system and the blade is extended upon sufficient reduction or cutting off of power from the engine driving the jet pump of the jet drive system, to improve stability as the watercraft decelerates. In further preferred embodiments, the blade is capable of controlled pivotal movement, to function as a rudder for improved steering of the watercraft, upon sufficient reduction in power from the drive system. Further preferred embodiments of the system include a variable filter for filtering water entering into the jet intake, where the filter opens and closes to vary flow resistance with drive power (or jet pressure) from the watercraft's drive system.

Further embodiments of the present invention employ or comprise an improved jet drive system powered by a modem automotive engine (or similar engine design) that is manufactured or modified for marine use, for example, in a conventional manner; In the take-out jet embodiments of the present invention, a jet drive system for a watercraft includes an automotive engine (or similar engine design), modified for marine use and connected to a jet pump in a conventional manner. The engine and pump are supported within a take-out jet structure. The take-out jet structure comprises an inner housing in which the engine block and pump are supported for operation, an outer housing fixed or unitary with the boat hull and a suspension structure for suspending the inner housing within the outer housing.

In a preferred embodiment, the suspension structure comprises a configuration of tubing that is pressurized or selectively pressurized with a gas or fluid. The tubing is interposed between the inner and outer housing to help suspend the inner housing within and spaced from the walls of the outer housing. In a further preferred embodiment, the inner housing is readily removable from the outer housing, to "take out" the drive system for easy service or replacement.

Further improved jet drive embodiments of the present invention employ an automotive engine or engine design that is manufactured or modified for marine use and which is modified or configured to employ the existing lower speed of the engine's camshaft to drive a jet pump. In one example, the engine is a four cycle engine with dual overhead camshafts that run at one-half the speed of the engine's crankshaft (which is the common camshaft speed in standard four-cycle engines). A half-speed camshaft drive system comprises a means for connecting a camshaft of such an engine to a jet pump, for half-speed operation of the pump relative to the engine's crankshaft speed. The camshaft sprocket or pulley may be modified or configured to be directly connected to the impeller or rotor of the jet pump.

In a preferred embodiment a watercraft includes each of the above systems, operable together, including a retractable rudder-fin and variable filter assembly for filtering water fed to the inlet of a jet drive system, where the jet drive system comprises a take-out jet system having an engine provided with a reduced-speed (half-speed) camshaft drive system, as described herein. However, other embodiments of the invention employ these systems individually or in various sub-combinations. For example, further embodiments relate to watercraft and systems for controlling watercraft that include a retractable rudder-fin system, with or without a variable filter assembly, for connection to other suitable drive systems and jet drive systems. Yet further embodiments may employ a take-out jet system, with or without a half-speed camshaft drive system. Furthermore, various aspects of each embodiment of the invention may be employed individually or in combinations, as apparent from the following disclosure.

BRIEF DESCRIPTION OF DRAWINGS

FIG. 12 is a side-perspective view of the rudder-fin and filter system of FIG. 10, with one side panel of the retractable rudder-fin portion of the system removed to show the rudder-fin in the fully retracted position.

FIG. 13 is a side-perspective view of the rudder-fin and filter system of FIG. 10, with one side panel of the retractable rudder-fin portion of the system removed to show the rudder-fin in the fully extended position.

DETAILED DESCRIPTION OF PREFERRED EMBODIMENTS

Figure 1:
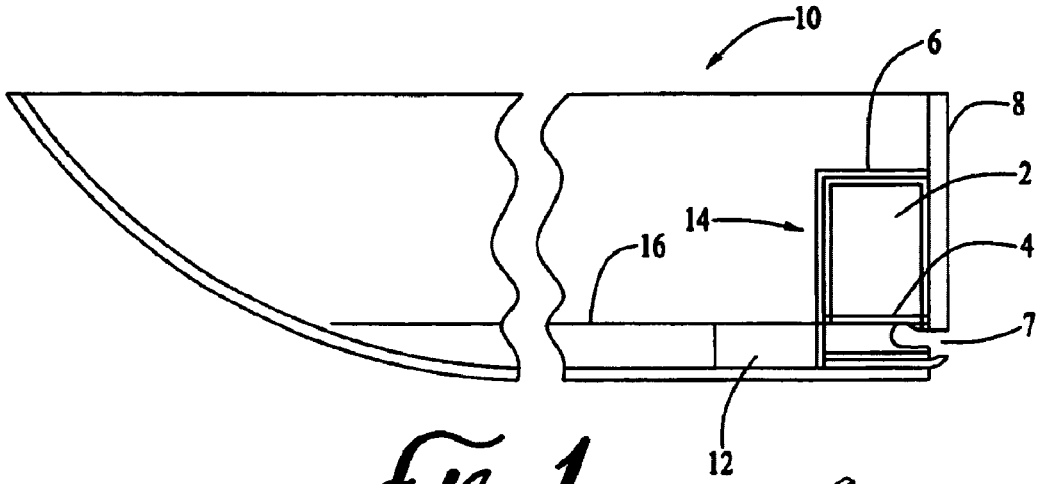
FIG. 1 is a generalized representation of a boat having a take-out jet system and a retractable rudder-fin and variable filter system, according to an embodiment of the present invention.

FIG. 1 is a generalized representation of a boat 10 having a retractable rudder-fin and filter system 12 and a take-out jet propulsion system 14 according to an embodiment of the present invention. The retractable rudder-fin and filter system 12 is located just forward of the take-out jet 14, for example, under the cockpit floor 16 of the boat 10. A middle section of the boat 10 is not shown, to save space in the drawing. As a representative example, the boat 10 may have a hull length of about 20 to 25 feet. However, further embodiments of the present invention may be employed with smaller or larger watercraft, including, but not limited to personal watercraft (PWC), such as jet skis, WaveRunners™ (a trademark of Yamaha Corporation) or the like.

While the embodiment in FIG. 1 is shown with both systems 12 and 14, other embodiments may employ a take-out jet system 14 without a retractable rudder-fin and filter system 12 as described herein. Yet other embodiments may employ a retractable rudder-fin and filter system 12 with another form of jet drive propulsion systems other than a take-out system 14 as described herein. Thus, systems 12 and 14 may be employed individually or, in more preferred embodiments, together.

According to further embodiments of the present invention, a drive system for a watercraft includes an automotive engine (or similar engine design) having a crankshaft and at least one camshaft, where the camshaft rotates at a speed half of the rotational speed of the crankshaft. The engine may be modified or manufactured for marine use in a conventional manner. The camshaft of the engine is coupled directly to the jet pump to provide a reduced speed drive connection to the pump, relative to the drive speed of the engine's crankshaft. The half-speed camshaft drive system may be employed with an engine in a take-out jet system 14. Alternatively, the half-speed camshaft drive system may be employed on watercraft powered by other jet drive systems, and with or without a retractable rudder-fin and filter system 12. However, a preferred embodiment of the present invention employs both systems 12 and 14, where the take-out jet system 14 includes an engine having a half-speed camshaft drive system.

1. The Take-Out Jet System

In FIG. 1, the take-out jet system 14 includes an engine or motor connected to power a jet pump. Preferred embodiments employ an automotive engine (or similar engine design), modified for marine use. The engine may be mounted in a horizontal position. However, in preferred embodiments, the engine is modified to run in the vertical position, in a conventional manner of powering jet pumps of a jet drive system.

The engine and jet pump are supported within a take-out jet housing structure. The take-out jet housing structure comprises an inner housing 2 in which the engine block and pump are supported for operation, an outer housing 6 fixed or unitary with the boat hull and a suspension structure (not viewable in FIG. 1) for suspending the inner housing within the outer housing.

In a preferred embodiment, the suspension structure comprises a configuration of tubing that is pressurized or selectively pressurized with a gas or fluid. The tubing is interposed between the inner and outer housing to help suspend the inner housing within and spaced from the walls of the outer housing. In a further preferred embodiment, the inner housing is readily removable from the outer housing, to "take out" the drive system for easy service or replacement.

With reference to FIG. 1, the inner housing 2 may be made of a suitably rigid, water-resistant material, such as, but not limited to, fiberglass, plastic, or suitably treated wood or metal. The inner drive system housing 2 may comprise a generally waterproof box, open on the top and closed on all other sides, for supporting the engine block. A water-tight bulk-head 4 may be provided a suitable distance from the bottom of the drive system housing 2. A jet pump is connected to the engine, for example, in a conventional manner (or with a reduced-speed camshaft drive system as described below), and is provided in the wet area, below the bulk-head 4. Suitable seals for the rotational coupling of the motor to the jet pump are provided through the bulk-head 4. The housing 2 is open at the top and may have slots or openings in its walls for air intake, control cables, hoses and tubes that are typically connected to an engine for powering a watercraft, for example, at the upper end of the housing 2, in the dry area above the bulk-head 4.

Thus, components of the engine (or other drive system) that may be damaged by contact with water may be located in the drive system housing 2, in the space above the bulk-head 4. The portion of the engine (or other drive system) and jet pump located below the bulk-head 4 may be made sufficiently water-tight, by employing suitable seals and water-compatible materials.

The outer housing 6 provides an opening 7, through which a jet outlet of the jet pump may operate. When assembled, the engine housing 2 is located within the outer housing 6, with the jet pump outlet aligned with the opening 7 in the outer housing 6.

The housing 6 may be built of a suitably rigid material, such as, but not limited to, fiberglass, plastic, treated wood or metal. In a preferred embodiment, the housing 6 may be made unitary with the boat structure and/or of the same material as that of the boat structure. For example, the boat may be built with a vertical stem or transom wall 8, which may form the back or aft side of the housing 6. The housing 6 may be provided with slots or openings at its upper end, through which air may pass for the air-intake for the engine. In addition, control cables, hoses, tubes, a gas line from a gas tank (not shown) installed in the boat hull and other linkages for connection to the engine may pass through such slots or openings.

Figure 2:
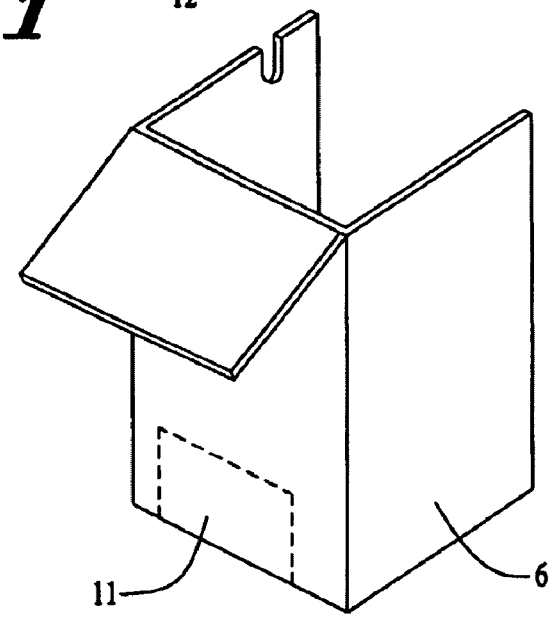
FIG. 2 is a generalized perspective view of an outer housing for a take-out jet system.

FIG. 2 is a perspective view of the outer housing 6, without the rest of the boat 10. The housing 6 may be built into the stern of the boat 10 of FIG. 1, for example, during the original construction of the boat, as described above. Alternatively, the housing 6 may be made separate from the rest of the boat and added to the rest of the boat during or after manufacture of the boat. The housing 6 may form an integral part of the hull of the boat and/or act as a brace between the boat bottom and the transom 8, in which case the transom 8 may be made lighter.

Figure 3:
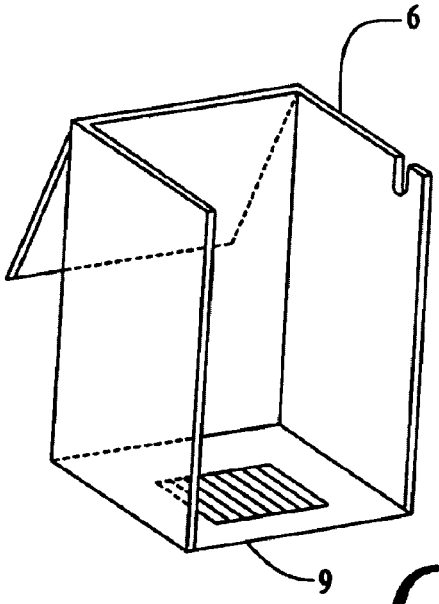
FIG. 3 is a generalized perspective view of the outer housing of FIG. 2, as viewed from the top, rear side of the housing.
Figure 6:
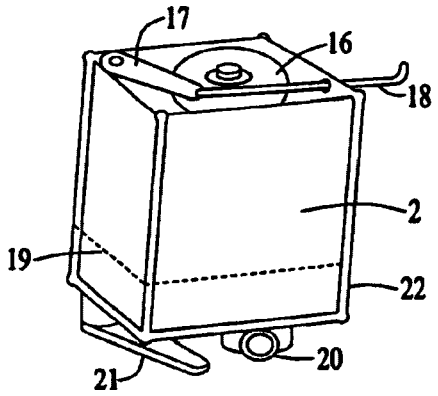

FIG. 3 is a perspective view of the outer housing 6, as viewed from the upper rear side of the housing. In FIG. 6, a bar-type grill 9 is shown at the bottom of the boat, to allow the entry of water for the jet pump that is located just above the grill when the inner engine housing 2 is assembled with the outer housing 6. The grill prevents large objects from entering the jet and damaging the jet components. In embodiments that employ a retractable rudder-fin and filter system 12 as described below, the housing 6 is provided with a water inlet port 11 (shown in broken lines in FIG. 2) for the jet drive system, where the inlet port 11 matches and seals to a port 117 on the housing for the retractable rudder-fin and filter system 12.

During operation, the interior of the housing 6 is flooded with water, to a depth determined by the amount that the stem of the boat is immersed. This may be deeper when stationary and with people standing or sitting near the stem of the boat. However, when the boat is moving at high enough speeds to plane, the housing 6 will contain no water and, thus, adds no water weight penalty.

The dual housing configuration, with the outer housing 6 containing the inner engine housing 2, can be configured relatively small, as compared to traditional engine mounting configurations. The inner housing 2, fits closely within the outer housing 6 and may be retained by a hinged, latched lid on the housing 6. A high pressure hose of generous length is extended between the jet volute and a pneumatic (such as an hydraulic) cylinder 126 employed in the retractable rudder-fin and filter system described below. By providing a hose of sufficient length, the inner housing 2 may be lifted out of the outer housing 6 for inspection without disconnecting the pressure hose. Alternatively, or in addition, a quick release coupler on the hose may allow the inner housing 2 to be completely removal as a self contained unit for servicing or replacement.

Another advantage of employing a twin housing configuration is that a leak in a rotary seal of the drive shaft (or other drive linkage between the engine and the jet pump) may only fill the limited space below the bulk head 4 of the inner housing 2. This feature may be important for boats that spend prolonged time at anchor. Embodiments of the present invention can provide a leak-resistant interface between the usual hand-operated levers in the dry areas of the boat and the moveable components in the wet area in the bottom of the housing 6.

Thus, a leak-resistant interface may be provided for controls for moving a jet steering sleeve laterally, moving the jet steering sleeve vertically for tilt or trim, and moving one or more reversing gates. For example, three separate push-pull wire or cable systems, as typically used on outboard motor systems, extend into the top of the outer housing 6, along the transom 8.

In a preferred embodiment, the control wires or cables connect to levers mounted on concentric tubes, for selectively rotating the tubes to cause selective movements of the jet steering mechanism, the jet tilt mechanism and the jet reversing mechanism. Typical jet drive systems employ a jet outlet that is selectively moveable in the lateral directions by cable or wire controls to selectively change the lateral direction of the jet for steering control. The jet outlet of a typical jet drive system is also selectively moveable by cable or wire controls to tilt upward or downward and provide tilt/trim control. Also, typical jet drive systems employ a reversing member that selectively actuated by cable or wire controls for reversing the direction of the jet, to selectively provide reversing power.

A concentric tube and lever arrangement employed in preferred embodiments of the take-out jet system allows these three (or more) common control cables or wires to be operatively connected to the jet pump, with minimal risk of leakage. In such preferred embodiments, The control cable or wire movements are translated to rotational movements of a plurality of concentric tubes that pass through the housing 2 within a sealed outer tube. More specifically, a configuration of multiple concentric, hollow tubes are provided, where each inner tube is rotatable about its longitudinal axis relative to each outer tube.

Figure 5:
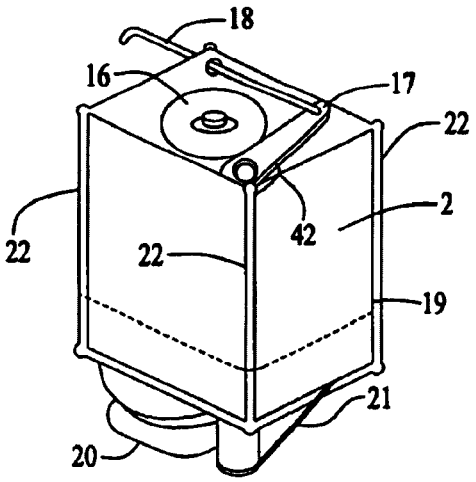
FIGS. 5–7 are generalized perspective views of an inner housing, outside of the outer housing of FIG. 2.
Figure 7:
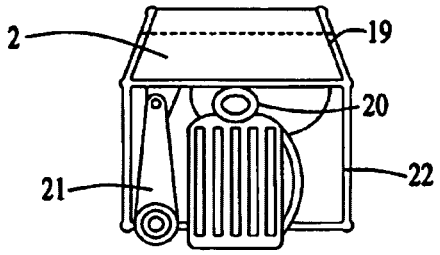
Figure 4:
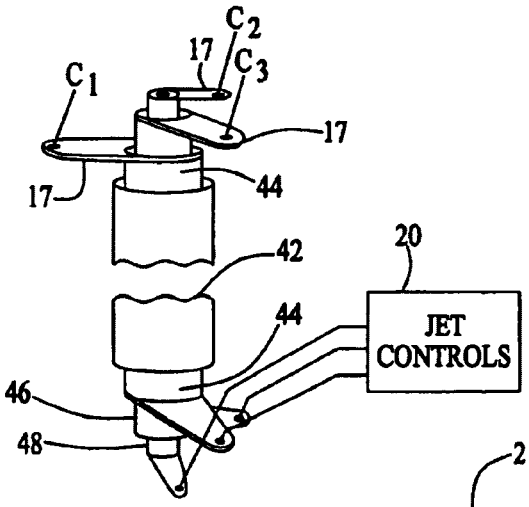
FIG. 4 is a generalized representation of a plural concentric tube configuration for communicating control movements to a jet pump, according to an embodiment of the invention.

With reference to FIG. 4, for a three cable or wire control system, the configuration of tubes 40 comprises a hollow outer tube 42. As shown in FIGS. 5–7 (described in more detail below), the outer tube 42 of the configuration of tubes 40 is secured and fixed to the inside of the housing 2. The outer tube 42 extends from the top of the housing 2, through the housing 2, and out of the bottom of the housing 2. A plurality (three for a three cable or wire control system) of smaller diameter tubes are arranged, concentrically, within the outer tube 42. A first one of the smaller diameter tubes 44 is rotatable (about its longitudinal axis) within the outer tube 42. A second one of the smaller diameter tubes 46 is disposed within and rotatable (about its longitudinal axis) relative to the first smaller diameter tube 44. A third one of the smaller diameter tubes 48 is disposed within and rotatable (about its longitudinal axis) relative to the second smaller diameter tube 46. Additional concentric tubes may be similarly arranged within the third smaller diameter tube 48, in a similar manner, for additional controls, as needed. The smallest diameter tube need not be hollow.

Each of the rotatable, smaller diameter tubes 44, 46 and 48 is provided with a pair of levers, one fixed on each end of each tube. The levers 17 on the upper ends of the tubes 44, 46 and 48 are each connected to a respective control wire or cable C1, C2 and C3, and may be moved (rotated about the axes of the tubes) to rotate the respective tubes by operation of its respective control wire or cable. Rotation of a tube 44, 46 or 48 by actuation of a respective control wire or cable will cause the lever on the bottom end of the tube to move (rotate about the axis of the tube) in a corresponding manner.

The levers 21 on the bottom ends of the tubes 44, 46 and 48 are connected, for example, through similar cables or wires or push-pull rods or the like, in a conventional manner, to conventional steering, tilt and reverse control structures of a jet pump 20. In this manner, rotation of the tubes 44, 46 and 48 by actuation of the control wires or cables connected to the levers on the upper ends of the tubes will cause rotation of the levers on the bottom ends of the tubes and, resulting operation of the steering, tilt and reverse control structures on the jet pump.

Also with the three smaller diameter tubes mounted in an outer tube 42 which is securely mounted in the bottom of the inner housing 2, the configuration of tubes 40 form a water tight stand pipe almost the full height of the inner housing 2. Any water that enters the tubes 40–46 will rise only to the level of the water in the outer housing 6 and will not leak into the engine area of the housing 2, because the upper ends of the tubes 40–46 are in the dry area above the bulk-head 4. A grease nipple may be mounted in the top of the inner tube and all three are drilled so that all are lubricated by the same source. A spring, or air pressure, in the inner tube can be used to make it hold lubricants.

FIGS. 5 through 7 are views of the inner engine housing 2 from different angles, showing various components of the engine and jet pump contained in the housing 2. FIG. 5 is a view from the upper front showing the top of the standard flywheel 16 of the engine, the outer tube 42, an upper lever 17 of the steering system and a push pull rod 18. Midway down the side, the dotted lines 19 show the location of the watertight bulk-head separating the upper engine compartment from the lower jet pump section. At the bottom, part of the jet pump 20 and some of the end of the lower lever 21 of the steering system can be seen.

In a further preferred embodiment, the inner housing 2 is readily removable from the outer housing 6, to "take out" the drive system for easy service or replacement. For example, the housing 2 may be lifted by a suitable crane, cherry-picker or other lifting structure capable of handling the weight of the engine held within the housing 2. Suitable length connection cables, wires, hoses and tubings may connect the engine to other components on the watercraft (such as control knobs or other operators, fuel tanks, etc.) may be employed, to allow the inner housing 2 to be lifted out of the outer housing 6, without disconnecting those elements. Quick-release connectors may be employed, where suitable, to allow easy disconnection of those elements, as needed.

Also in a preferred embodiment, a suspension structure supports the inner housing 2 within the outer housing 6 and provides a cushioning or damping function between the inner and outer housings. For example, such suspension structure may comprise a configuration of flexible tubing that is interposed between the inner housing 2 and outer housing 6 and is pressurized or selectively pressurized with a gas or fluid. The flexible tubing may be attached to the outer surfaces of the inner housing 2, the inner surfaces of the outer housing 6, or both. Alternatively, or in addition, the flexible tubing may be arranged between the housings 2 and 6, but unattached and separable from the housings 2 and 6.

Figure 8:
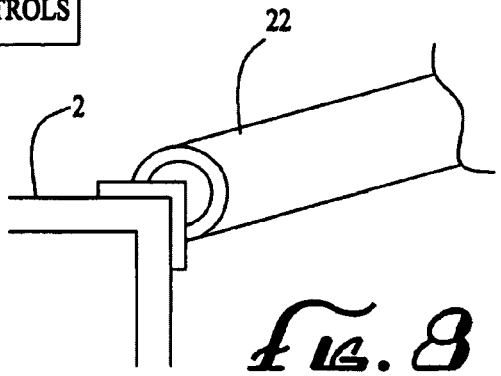
FIG. 8 is a generalized cross-sectional, perspective view of a tubing structure on certain edges of the inner housing of FIGS. 4–7.

One example embodiment in which the flexible tubing is attached to the inner housing 2 is shown and described with reference to FIGS. 5 through 7. In FIGS. 5 through 7, the four vertical edges and the four horizontal bottom edges of the inner box 2 are covered with a cushioning material. In a preferred embodiment the cushioning material comprises a rubber or synthetic rubber hollow tubing 22, as shown in FIG. 8. The hollow interior of all eight edge lengths of the tube may be connected to provide a pneumatic suspension for the inner box, when pressurized. In a preferred embodiment, the interconnected tubes may be filled with a pressurized gas or fluid. In further preferred embodiments, pressure gauges and/or gas or fluid reservoirs may be connected in the pneumatic system, to provide a regulatable pressure within the interconnected tubes.

In yet further preferred embodiments, since recreational boats may be stored or otherwise not operated for prolonged lengths of time, the pneumatic system may be provided with suitable controls to pressurize the interconnected tubes only when the boat engine is running. For example, a hydraulic pump or hydraulic accumulator with a separator piston or diaphragm may be employed with an air end connected to the pneumatic suspension system, such that the no pressure is provided when the engine is not running. In one example embodiment, the hydraulic side of the piston may be connected, through a suitable pressure tube, to the volute of the jet pump to receive a pressure differential from the jet pump. The pressure from the jet pump volute may be employed to drive the piston and pressurize the suspension system when the engine is running. In yet further embodiments, a pressure source other than the jet volute may be employed and controlled to provide pressure to the tubing of the suspension system when the engine is running, including, but not limited to, pressurized gas or fluid canisters controlled by electronic, manual or mechanical valves.

While embodiments shown in FIGS. 4 through 7 employ a pressurized tubing structure that is secured to the outer surfaces or comers of the inner housing 2, other embodiments may employ pressurized tubing structure that is secured to the inner surface or inner comers of the outer housing 6. In yet other embodiments, pressurized tubing structures may be secured to the inner housing and the outer housing.

2. Retractable Rudder-Fin and Filter System

Figure 9:
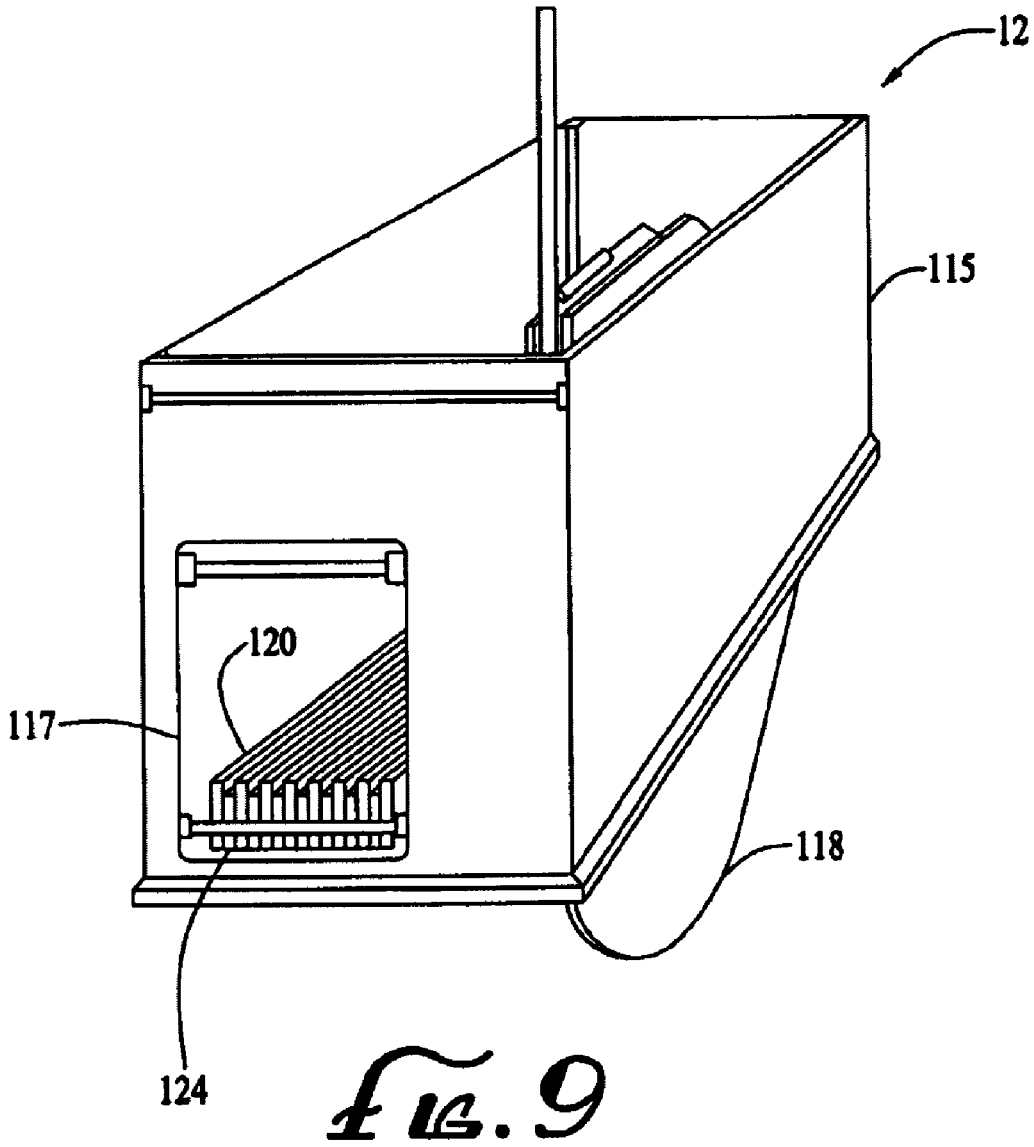
FIG. 9 is a generalized perspective view of an outer box of a retractable rudder-fin and filter system, as viewed from the back & the water transfer port, according to an embodiment of the present invention.

FIG. 9 is a generalized perspective view of the outer housing 115 of a retractable rudder-fin and filter system 12 according to an embodiment of the present invention. In one example embodiment, the housing 115 is permanently built into the hull of the boat, just forward of the outer housing 6 of a take-out jet system (or the structure containing any other suitable jet drive system). A slot or opening in the bottom of the boat, just under the system 12, allows a rudder-fin blade to protrude from the bottom of the boat, when extended, and allows water to enter the filter side of the system 12. The housing 115 may be made during the construction of the boat. In further embodiments, the housing 115 is installed after construction of the boat.

The housing 115 may fit in the bilge space under the floor of the boat. The bilge is a little used space in small boats, and well aft is the ideal place to install both a water intake and a fin, as this is the last part of the boat to leave the water when bouncing at speed in heavy waves. The housing 115 may be open on the bottom, to allow water to enter and to allow the rudder-fin blade to protrude, when extended. The housing 115 includes an opening or transfer port 117, adjacent and sealed with a corresponding port on in outer engine box. The transfer port 117 is arranged to align with a matching opening or port 11 (FIG. 2) provided in the outer housing 6 of a take-out jet system as described above. In embodiments in which other types of jet drive systems are used, the transfer port 117 similarly aligns with a matching port of the structure in which the jet drive intake is contained. Suitable seals are provided between the transfer port 117 and the matching opening on the housing 6 or other containment structure.

In FIG. 9, a portion of the retractable fin 118 is shown, partly extended through the bottom of the housing 15 and through a slot or opening in the bottom of the boat 10. The system 12 includes a retraction support structure for supporting a fin 118 for movement between a retracted and extended position. The system 12 also includes a mechanism for moving the fin 118 into a retracted position when sufficient power is provided to the jet drive system by the engine, and for moving the fin 118 into an extended position when the power to the jet drive system is sufficiently reduced or cut off.

Figure 10:
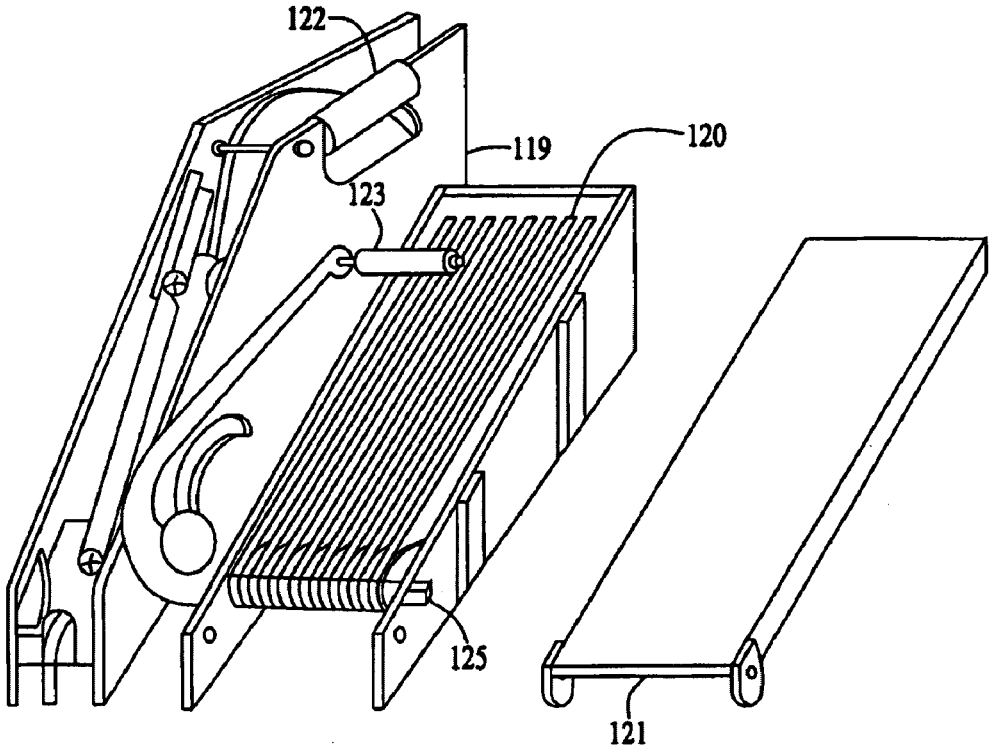
FIG. 10 is a generalized perspective view of an example of a retractable rudder-fin and filter system without its outer box, with its deflector plate removed and set to one side and with its rudder fin in a fully retracted position.

FIG. 10 is a perspective view of the retractable rudder-fin and filter system 12, removed from its outer casing 115 and with the cover 121 removed for inspection or service. The system 12 provides two functions, comprising a rudder-fin stablizing and steering function and a water intake filter function for the jet drive propulsion system. A mounting bulkhead 119 separates the two functional components of the system 12, where the filter portion is shown on the right side of FIG. 10 and the retractable rudder-fin portion is shown on the left side of FIG. 10.

Figure 11:
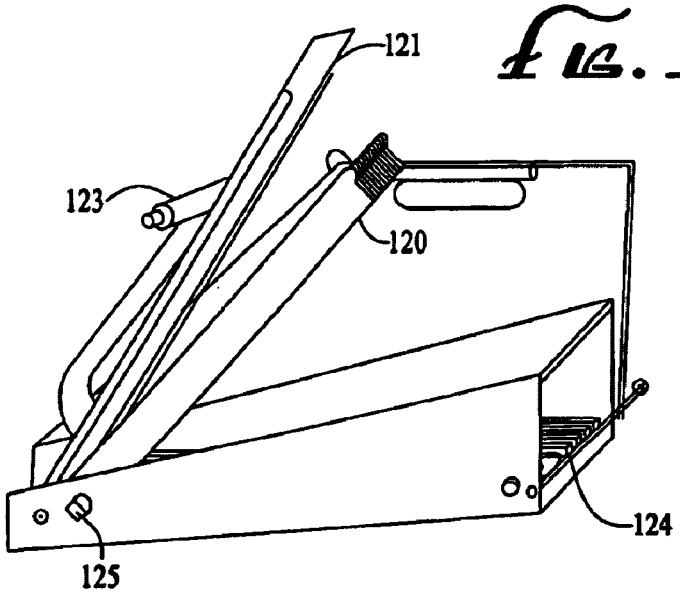
FIG. 11 is a side-perspective view of the filter portion of the retractable rudder-fin and filter system of FIG. 10, with the filter in a cleaning position.

The filter portion of the system 12 includes a plurality of moveable blades 120 and a plurality of stationary blades 124 (shown in FIG. 11). The stationary blades 124 are arranged over the opening in the bottom of the boat, for allowing water to enter the filter portion of the system 12, by passing through spaces between the blades of the stationary blades 124. The moveable blades 120 are pivotally attached to the stationary blades and are moveable between a full throttle position (or open, working position) and a low throttle or no throttle (or closed, working position) during operation. The moveable blades 120 are also moveable into a cleaning position, for cleaning or repairs. In FIG. 9, the moveable blades are partially shown through the port 117, in a closed, working position, wherein the moveable blades 120 are partially or fully interleaved between the stationary blades 124. Small gaps between the movable-and stationary blades allow the passage of water between the blades when the blades are in the closed, working position.

In FIG. 10, the moveable blades 120 are arranged in their full throttle open working position The moveable blades 120 in FIG. 10 are pivoted relative to the position shown in FIG. 9, such that a substantial portion of the length of the moveable blades are not interposed between the stationary blades. As such, no portions of the moveable blades are interposed between the stationary blades along a substantial length of the stationary blades Thus, in the open, working position of FIG. 10, water may pass through gaps between the stationary blades without obstruction by the moveable blades. In this manner, the moveable blades function as a variable filter for filtering water before the water enters the jet drive system and for varying the flow of water by varying the relative position of the moveable blades among all possible positions between open and closed, working positions. The variable jet water inlet filter should allow full flow at maximum power and progressively increase the filtration as the throttle is closed.

In FIG. 11, the moveable blades 120 are moved into a cleaning position, where an operator may easily access weeds, rope, nets, or other debris that may have been trapped within the blades of the filter. In the cleaning position, the moveable blades 120 are pivoted further apart from the stationary blades and the cover 123 is opened to provide access to the space between the moveable and stationary blades.

A handle 122 may be provided, for example, at the top of the mounting bulkhead 119, for allowing an operator to readily lift the whole system 12 out of its housing 15. Another handle 123 may be provided for separating the moving blades 120 and the fixed blades 124 by pivoting the moving blades 120 from the position shown in FIG. 10 to the position shown in FIG. 11, for cleaning, inspection or repair.

A rotatable shaft 125 is connected to the handle 123 and the moveable blades 120, such that by pulling the handle 123 upward and to the left as shown in FIG. 11, the handle 123 rotates the shaft 125. Rotation of the shaft 125 causes the moveable blades to rotate about the axis of the shaft 123, and raise to the cleaning position shown in FIG. 11, where they are clear of the fixed blades 124. As the blades 120 rotate to the cleaning position, they push against and open the cover 121. Because the top of the outer housing 115 is above the water line, this operation can be done while afloat. In extreme cases of fouling, as with rope and fishing nets, the whole unit can be removed and placed on the cockpit floor for a more thorough cleaning or repairing operation.

Both the water intake filter and the fin rudder can be designed to move in the same direction between idle and full power, so one single hydraulic cylinder can move both elements at the same time. In the interest of simplicity, the hydraulic cylinder can be arranged to be hydralically driven in one direction only, the easiest being to extend under pressure, while an external or an internal compression spring around the piston ramrod provides sufficient force for retracting or closing the cylinder. In the drawings, an external compression spring 110 is shown. However, further preferred embodiments may employ a coil spring located inside of the cylinder 126.

FIG. 12 is a side-perspective view of the retractable rudder-fin and filter system 12, with a side panel removed, to show components of the rudder-fin portion of the system. The rudder fin portion of the system includes a rudder-fin blade 118, which is moveable between a fully extended position (shown in FIG. 13) and the fully retracted position (shown in FIG. 12).

The rudder-fin portion of the system 12 includes a pneumatic (preferably, hydraulic) cylinder 126, which is normally urged into a closed position by a spring 110. When the cylinder 126 is in the closed position (i.e., no or not sufficient pressure is provided to the cylinder 126), the rudder-fin blade 118 is normally positioned in the fully extended position of FIG. 13. The hydraulic cylinder 126 has a fitting 129, for connection to a pressure source, to selectively apply pressure to the cylinder. A pressure tubing may be connected between the jet volute of the jet pump and the fitting 129, to provide pressure to the cylinder 126. The blade 118 may be moved from the extended position to a retracted position by applying sufficient pressure to the cylinder 126. Thus, if the blade is initially in an extended position as shown in FIG. 13 and, while in this position, pressure is applied to the cylinder 126, the cylinder piston will be pushed outward (i.e., the cylinder expands) and the lower anchorage of the cylinder will force an upper web 130 of the blade 118 to the right (relative to its position in FIG. 13) to cause the blade 118 to rotate (clockwise in FIG. 13) about the axis of shaft 125, toward the retracted position shown in FIG. 12. When pressure is released or sufficiently reduced, the cylinder 126 retracts under the force of the spring 110. As the cylinder retracts, the anchorage connection to the web 130 of the blade 118 moves the web 130 back (to the right in FIG. 13) to rotate the blade 118 (counterclockwise in FIG. 13) toward its retracted position shown in FIG. 12.

The rudder-fin portion of the system 12 also includes a mechanism for manually placing the blade 118 into a fully retracted position, when the jet drive power is off. Thus, when the watercraft is being stored or removed from the water, it may be desirable to fully retract the blade 118. An example of a manual retraction mechanism comprises a rocking lever 127, mounted to the bulkhead 119 by a pivotal connection. The rocking lever 127 has a first end connected, through a manually operated control rod, cable or wire 128, to a manually operable control knob or the like.

In normal operation, the control rod 128 is positioned, as shown in FIG. 13, to force the connected end of the rocking lever 127 downward. A second end of the rocking lever 127 is connected to a top anchorage of the cylinder 126. When the lever 127 is in the position shown in FIG. 13, the blade 118 is free to extend or retract, in response to expansion and contraction of the cylinder 126 (which is responsive to the pressure in the jet volute, as described above). When the lever 127 is moved by actuation of the control rod 128 from the position shown in FIG. 13, toward the position shown in FIG. 12, the lever (being connected to the top anchorage of the cylinder 126) moves the cylinder 126 downward. The downward movement of the cylinder will force the upper web 130 of the blade 118 to the right (relative to its position in FIG. 13) to cause the blade 118 to rotate (clockwise in FIG. 13) about the axis of shaft 125, toward the retracted position shown in FIG. 12. In this manner, the control rod 128 may be operated to manually move the blade 118 into its retracted position, even if the engine power is turned off.

The rudder-fin blade 118 is pivotal about the axis of the shaft 125. Also, the blade is engaged with the shaft 125 in a manner that will cause rotation of the shaft 125 as the blade 118 pivots about the axis of the shaft 125. For example, the shaft 125 and the shaft opening in the blade 118, , may be keyed to each other or may have rectangular cross-sectional shapes (or any cross-sectional shape that will transfer torque between the blade and the shaft). When the rocking lever 127 is pulled up into the position shown in FIG. 12 by the manually operated control rod 128, the lever 127 moves the upper anchorage of the cylinder 126 down and to the right for its full stroke, forcing the lower end of the cylinder 126, which is attached to the upper end of the rudder-fin blade 118 to the right, to fully retract the fin 118.

With reference to FIG. 13, in which the rudder-fin blade 118 is in the fully extended position, the lever and the manual control rod is are fully down. In that state, the rudder-fin blade 118 is ready to be retracted by the extension of the cylinder by pressure from the jet pump volute when the engine starts.

With this arrangement the rate and strength of the spring opposing the power output of the engine, expressed as pressure in the volute of the jet pump, can be balanced. In this manner, the spring tension may be selected for a particular boat design such that, at a given speed of the particular boat hull, the amount of the blade exposed is just enough to provide a desired directional stability. Moreover, after the boat builder has experimentally selected what he considers the best compromise spring for all conditions under which this hull may be expected to operate, the selected spring may be built into the cylinder 126, to inhibit after-market adjustments.

Figure 14:
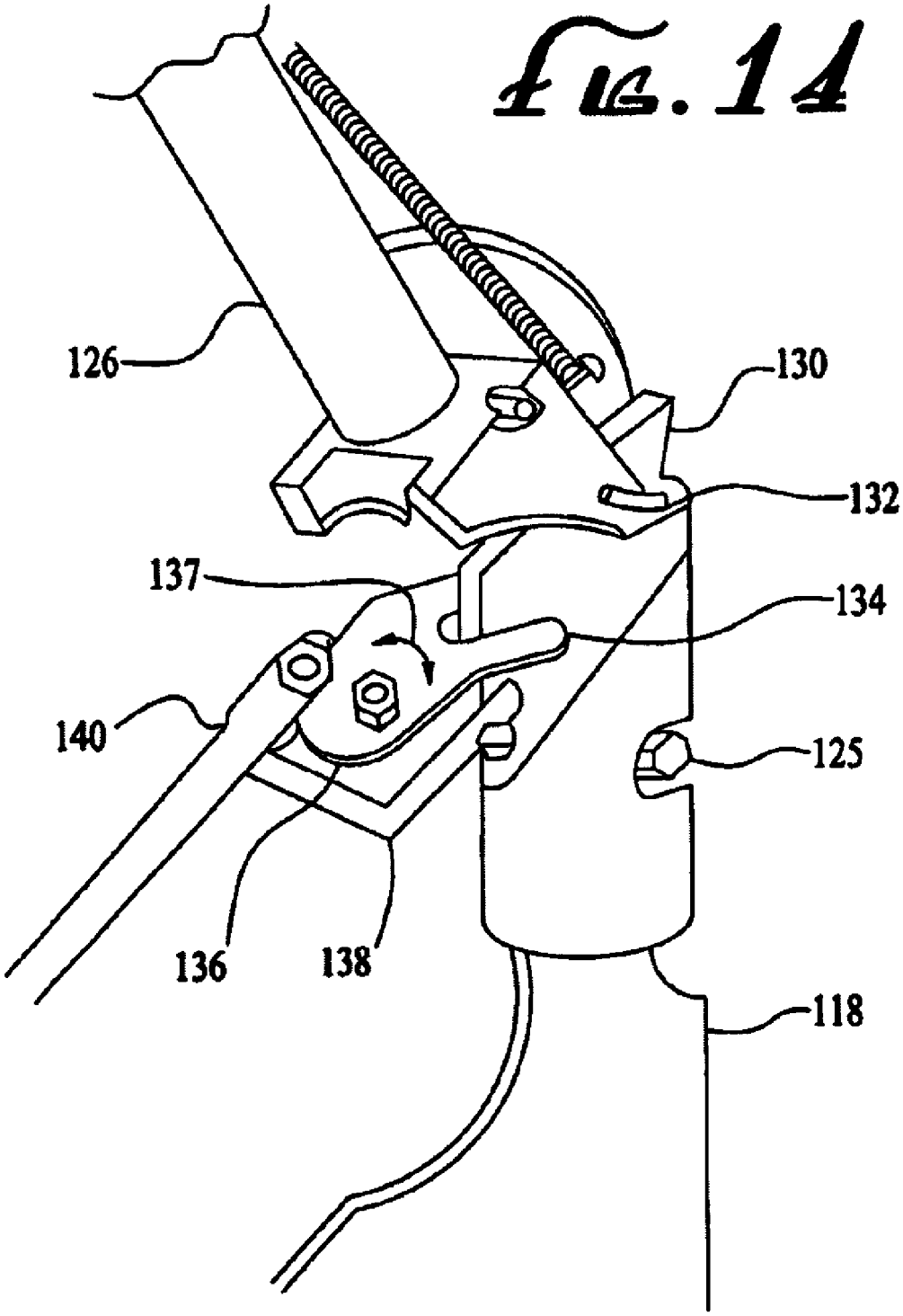
FIG. 14 is a perspective view of an example of a mechanism which turns the fin into a rudder only when it is in a sufficiently extended position.

FIG. 14 is an enlarged view on the area at the top of the rudder fin blade, showing an example of a mechanism which allows the rudder-fin blade to operate, at times, as a fin for directional stability and, at other times, as a rudder for steering. When pivoting between retracted and extended positions, the rudder-fin blade 118 rotates about the shaft 125. As noted above, the shaft 125 may be square (or be keyed or have another suitable cross-sectional shape to allow transfer of torque between the blade 118 and the shaft 125, such that rotation of the blade between retracted and extended positions (with pressure from the jet pump) will also cause rotation of the shaft 125 with pressure differentials from the jet pump. However, the squared edges of the shaft 125 may be rounded off to facilitate ready rotation of the rudder-fin blade 118. The rudder-fin blade 118 may be provided with an opening or hole to engage the shaft 125, where the opening or hole is tapered or elongated to permit the blade 118 to be moved a limited amount about a vertical axis to act as a rudder, but only when it is in the fully down position.

The upper end of the blade 118 has a flat web section 130 extending fore and aft and pivotally connected to the end of the piston of the cylinder 126, by a connector pin 132. This flat section of the web 130 extends between a pair of jaws 134 of a lever 136, when the blade 118 is positioned in a sufficiently extended position, such as a fully extended or nearly fully extended position. However, the flat section of the web 130 is moved out from between the jaws 134 of the lever 136, when the blade 118 is pivoted toward the retracted position.

The lever 136 is mounted on a bracket 138 that is fixed to the bulkhead 119. The lever 136 is mounted for pivotal motion as shown by arrow 137. The lever 136 is connected by a push-pull rod 140 that is linked into the jet steering sleeve, so when the steering wheel is moved, the lever 136 is pivoted and the rudder also pivots in the appropriate direction. However, because the jaws 134 of the lever 136 engage the web 130 only when the blade 118 is in a sufficiently extended position, the lever 136 can only move the blade 118 as a rudder when the blade is sufficiently extended, such as in the fully extended or nearly fully extended position shown in FIG. 14. At all other times the blade 118, if partially extended, operates as a fin, with its back edge in a tight slot in the bottom of the boat-box joint. Moreover, when extended or partially extended, the blade 118 is free to be forced back flush with the hull, upon hitting an obstruction, or upon manual retraction. The cylinder 126 may dampen the forced retraction motion, but will allow the blade 118 to be quickly moved back into or toward a retracted position to avoid or minimize damage, if the blade strikes an obstruction when extended.

Thus, according to embodiments of the present invention, a rudder blade may be lowered into operating position, only when the jet stream from the jet drive system of the boat is inoperative and the boat is slowing down. Because the rudder blade may be extended as quickly as the pressure in the volute falls, it is in the ideal position to take over the steering as the boat slows down.

The embodiment shown in FIGS. 12 through 14 is one example of a suitable mechanism for rotating or pivoting a blade between retracted and extended positions. Other embodiments may employ other suitable rotating or pivoting structure for movably supporting the blade. Also, while embodiments described above employ a mechanism for rotating or pivoting a rudder-fin blade, other embodiments may employ other mechanisms for moving the blade between retracted and extended positions. For example, the blade may be supported for linear motion and controlled by an hydraulic cylinder, cable-operated linkage or the like to move linearly through a slot in the bottom of the boat, between retracted and extended positions.

3. Reduced Speed Camshaft Drive System

Figure 15:
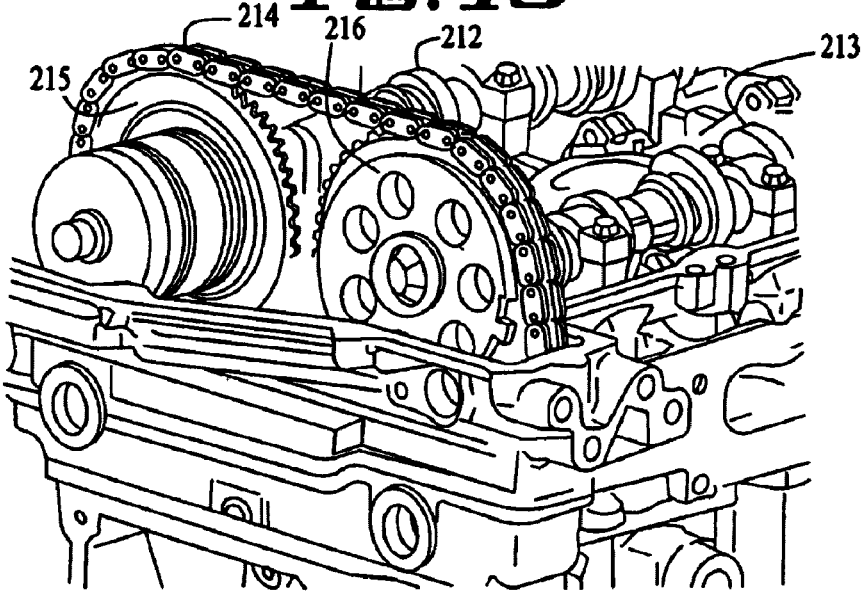
FIG. 15 is a perspective view of a portion of a conventional engine with a dual overhead camshaft configuration.

Further improved jet drive embodiments of the present invention employ an automotive engine or engine design that is manufactured or modified for marine use and which is modified or configured to employ the existing lower speed of the engine's camshaft to drive a jet pump. Typical modem automotive engines or automotive design engines have a crankshaft and at least one camshaft that rotates at a speed less than the crankshaft. For example, FIG. 15 shows a portion of a conventional engine that has a dual, overhead camshaft configuration with a first camshaft 212 and a second camshaft 213. The camshafts are driven by a timing chain 214 on chain sprockets 215 and 216 fixed to one end of the camshafts. In other engine designs, the camshaft may be similarly connected to a timing belt pulley. In either case, the camshaft is driven by the crankshaft, through a chain or belt, at a rotational speed that is less than the rotational speed of the crankshaft. In a typical four-stroke engine, the camshaft is driven at one-half the speed of the crankshaft.

Figure 16:
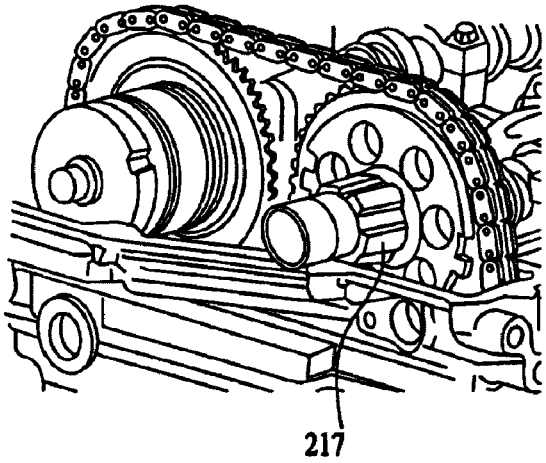
FIG. 16 is a perspective view of a portion of the engine of FIG. 15, but with a splined or fluted cylindrical extension on one camshaft sprocket gear for connection to a jet pump, according to an embodiment of the present invention.

FIG. 16 shows an embodiment of a half-speed camshaft drive system, which comprises a coupling 217 connected to one of the camshaft's sprocket 216 and rotatable at the rotation speed of the camshaft. The coupling 217 in FIG. 16 comprises a splined or fluted cylindrical extension having a plurality of ridges and grooves around its outer peripheral surface. A corresponding receptacle, having a mating set of ridges and grooves, is provided on the rotor of the jet pump, for direct connection of the jet pump to the camshaft sprocket 216. In this manner, the jet pump rotor may be driven at the rotational speed of the camshaft of the engine, which is one half the speed of the crankshaft of the engine. In further embodiments, the receptacle may be coupled to the camshaft sprocket, while the extension is coupled to the jet pump rotor.

Figure 17:
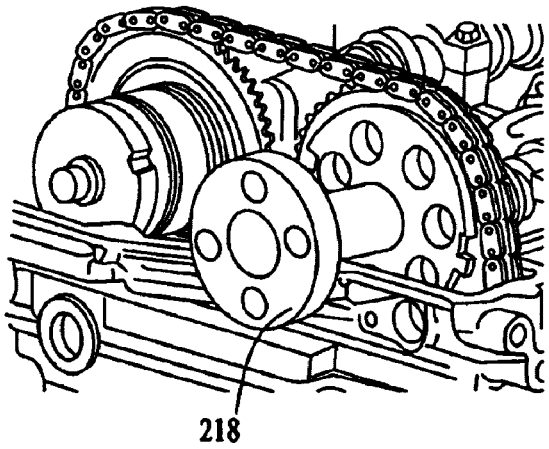
FIG. 17 is a perspective view of a portion of the engine of FIG. 15, but with a four-bolt flange connector for connection to a jet pump, according to another embodiment of the present invention.

While FIG. 16 shows a splined or fluted extension 217, other suitable coupling means may be employed, including, but not limited to, a four-bolt flange 218 as shown in FIG. 17. Such four-bolt flanges are common in the boating industry, for connection of marine engines to propeller shafts. While the four-bolt flange may be relatively inexpensive, the splined or fluted extension 217 may be preferred where minimizing space is a concern and for engines installed in a vertical position, such as in a take-out jet system as described above.

What is claimed is:

1. A watercraft apparatus comprising:

a hull;

a jet pump;

an engine supported within the hull, the engine having a crankshaft and at least one camshaft, each camshaft being driven at a reduced speed relative to the crankshaft;

a coupling structure operatively coupling the jet pump to the at least one camshaft to drive the jet pump at the reduced speed of the camshaft, the jet pump supported for providing drive power to drive the hull on water.

2. The apparatus of claim 1, wherein the reduced speed of the camshaft is one half the speed of the crankshaft.

3. The apparatus of claim 1, further comprising a retractable blade extendable below the bottom of the watercraft in response to a reduction in power from the engine to the jet pump below a predetermined amount.

4. The apparatus of claim 1, wherein the engine and jet pump are supported by a take-out jet housing structure comprising:

a first housing containing the engine with the jet pump coupled thereto;

a second housing fixed to the hull;

a suspension system for suspending the first housing within the second housing and allowing the first housing to be removed from the second housing for inspection, repair or replacement.

5. The apparatus of claim 4, wherein the suspension system comprises tubing attached to outside surfaces of the first housing, inside surfaces of the second housing or both.

6. The apparatus of claim 5, wherein the suspension system further comprises a pressure source connected to the tubing, for providing pressurized fluid or gas into the tubing.

7. The apparatus of claim 6, wherein the pressure source is controlled to provide pressurized fluid or gas in response to starting or running of the engine.

8. A watercraft apparatus comprising:

a hull;

a jet pump;

an engine supported within the hull, the engine having a crankshaft and at least one camshaft, each camshaft being driven at a reduced speed relative to the crankshaft;

a jet pump operatively coupled to the at least one camshaft to be driven at the reduced speed of the camshaft, the jet pump supported for providing drive power to drive the hull on water, wherein the jet pump is coupled to at least one camshaft through a direct connection link comprising a splined extension member and a matching socket, wherein the splined extension member is provided on either one of a sprocket of the camshaft or a rotor of the jet pump, and wherein the mating socket is provided on the other one of the sprocket or rotor.

9. The apparatus of claim 1, wherein the jet pump is coupled to at least one camshaft through a direct connection link comprising a multi-bolt flange.

10. A watercraft apparatus comprising:

a hull;

a jet pump;

an engine supported within the hull and operatively coupled to the jet pump to provide power to the jet pump;

a retractable blade extendable below the bottom of the watercraft in response to a the a reduction in engine power to the jet pump below a predetermined amount, wherein the retractable blade comprises a blade member supported for pivotal motion about an axis of a shaft, an expandable and retractable cylinder connected to the blade member at a location laterally offset to one side of the shaft, to selectively pivot the blade member about the axis of the shaft with the expansion or retraction of the cylinder;

a filter supported by the hull, for filtering water before the water enters the jet pump, the filter comprising a movable filter element movable between higher and lower engine power positions, wherein the movable filter element is connected to the shaft to move between higher and lower engine power positions in response to rotation of the shaft.

* * * * *